US012071943B2

(12) United States Patent
Alexander et al.

(10) Patent No.: US 12,071,943 B2
(45) Date of Patent: Aug. 27, 2024

(54) FLUID SENSING SAFETY

(71) Applicant: FNA Group, Inc., Pleasant Prairie, WI (US)

(72) Inventors: Gus Alexander, Inverness, IL (US); Chris Alexander, Park Ridge, IL (US); Richard J. Gilpatrick, Burlington, WI (US); Peter D. Joseph, Mukwonago, WI (US); Robert E. Dowd, Oconomowoc, WI (US); Shawn M. Mulkins, Zion, IL (US)

(73) Assignee: FNA GROUP, INC., Pleasant Prairie, WI (US)

( * ) Notice: Subject to any disclaimer, the term of this patent is extended or adjusted under 35 U.S.C. 154(b) by 0 days.

(21) Appl. No.: 17/189,651

(22) Filed: Mar. 2, 2021

(65) Prior Publication Data

US 2021/0270259 A1 Sep. 2, 2021

Related U.S. Application Data

(60) Provisional application No. 62/983,885, filed on Mar. 2, 2020.

(51) Int. Cl.

| | |
|---|---|
| ***F04B 49/02*** | (2006.01) |
| ***F04B 17/05*** | (2006.01) |
| ***F04B 49/06*** | (2006.01) |
| ***F04B 49/10*** | (2006.01) |

(52) U.S. Cl.

CPC ..... *F04B 49/02* (2013.01); *F04B 17/05* (2013.01); *F04B 49/06* (2013.01); *F04B 49/10* (2013.01); *F04B 2205/01* (2013.01); *F04B 2205/05* (2013.01)

(58) Field of Classification Search

CPC ..... F04B 49/02; F04B 49/06; F04B 2205/01; F04B 2205/05

USPC ..... 417/19, 34; 73/780

See application file for complete search history.

(56) References Cited

U.S. PATENT DOCUMENTS

| | | | | | |
|---|---|---|---|---|---|
| 3,362,224 | A * | 1/1968 | Melone | H01M 50/60 | 359/837 |
| 4,620,835 | A * | 11/1986 | Bell | F04B 49/06 | 4/504 |
| 4,749,988 | A * | 6/1988 | Berman | G01F 23/268 | 73/304 C |
| 5,244,351 | A * | 9/1993 | Arnette | F04D 15/0218 | 417/44.1 |
| 6,112,342 | A * | 9/2000 | Breda | E03C 1/023 | 137/454.2 |
| 6,830,082 | B2 * | 12/2004 | Few | B60S 5/00 | 141/2 |
| 7,013,910 | B2 * | 3/2006 | Tripp | E03C 1/108 | 137/512 |
| 7,127,943 | B1 * | 10/2006 | Griffiths | G01F 23/265 | 73/304 C |
| 7,316,541 | B2 * | 1/2008 | Baron | F04B 53/18 | 417/13 |
| 7,987,042 | B2 * | 7/2011 | Shinogi | G01F 23/70 | 123/195 S |

(Continued)

*Primary Examiner* — Christopher S Bobish

(74) *Attorney, Agent, or Firm* — Brian J. Colandreo; Jeffrey T. Placker; Holland & Knight LLP

(57) ABSTRACT

A fluid sensing safety may include a pump, and a prime mover configured to drive the pump. A fluid vessel may be associated with the pump. A sensing system may be configured to determine the presence of fluid within the fluid vessel.

6 Claims, 13 Drawing Sheets

(56) References Cited

U.S. PATENT DOCUMENTS

| | | | | |
|---|---|---|---|---|
| 8,479,573 | B2 * | 7/2013 | Baily | A61M 1/0001 73/304 C |
| 8,657,583 | B2 * | 2/2014 | Ward | F04D 13/16 417/36 |
| 9,725,888 | B2 * | 8/2017 | Cellemme | F16K 17/02 |
| 10,465,674 | B2 * | 11/2019 | Pines | F04B 51/00 |
| 10,557,480 | B1 * | 2/2020 | Gharakhanian | F04B 35/06 |
| 10,711,787 | B1 * | 7/2020 | Darley | F04D 29/4293 |
| 2002/0131866 | A1 * | 9/2002 | Phillips | F04B 49/065 417/36 |
| 2006/0125646 | A1 * | 6/2006 | McPherson | F04D 15/0088 340/606 |
| 2007/0177985 | A1 * | 8/2007 | Walls | F04B 49/10 417/44.2 |
| 2011/0146399 | A1 * | 6/2011 | Burdi | G01F 23/261 73/304 C |
| 2012/0118412 | A1 * | 5/2012 | Barry | G05D 9/12 73/304 C |
| 2014/0119949 | A1 * | 5/2014 | Wischstadt | F04B 17/05 417/34 |
| 2015/0159657 | A1 * | 6/2015 | Roussel | F04D 27/004 417/19 |
| 2017/0159270 | A1 * | 6/2017 | Garg | H04N 21/478 |
| 2018/0138839 | A1 * | 5/2018 | Puzio | H02K 11/28 |
| 2018/0258893 | A1 * | 9/2018 | Fischer | F02M 37/106 |
| 2019/0339162 | A1 * | 11/2019 | Munk | G01N 29/036 |

* cited by examiner

FLUID SENSING SAFETY

CROSS-REFERENCE TO RELATED APPLICATION

This application claims the benefit of U.S. provisional patent application Ser. No. 62/983,885, entitled "FLUID SENSING SAFETY," filed on Mar. 2, 2020, the entire disclosure of which is incorporated herein by reference.

TECHNICAL FIELD

In general, the present disclosure may relate to fluid sensing systems, and more particularly relates to safety systems using fluid sensing.

BACKGROUND

Many domestic and commercial water usage applications may require relatively high pressures, which may be beyond the capacity of residential and/or municipal water distribution and supply systems. For example, heavy duty cleaning applications may benefit from increased spraying pressure that is greater than the pressure available from common residential and/or municipal water distribution and supply systems. In some situations, various nozzles may be utilized to constrict the flow of the water to provide an increase in the pressure of the resultant water stream. However, many tasks may benefit from even greater pressures than can be achieved with common pressure nozzles that may be attached to a hose. In such circumstances pressure washers may be utilized, in which a power driven pump may be employed to increase the pressure significantly above pressures that are readily achievable using hose attachments. Such elevated pressures may increase the efficiency and/or effectiveness of some cleaning and spraying tasks.

While the increase in pressure that may be provided by a pressure washer may be useful for many applications, in many circumstances the demand for the pressurized water may be intermittent, or required on a stop and go basis. Often the intermittent demand for the pressurized water may be satisfied by manually starting an engine driving the pressure washer when the pressurized water is needed, and stopping the engine during time periods when the pressurized water is not needed. However, the need to continually start and stop the engine can often be viewed as burdensome or inconvenient.

SUMMARY

According to an implementation a fluid sensing safety may include a pump, and a prime mover configured to drive the pump. A fluid vessel may be associated with the pump. A sensing system may be configured to determine the presence of fluid within the fluid vessel.

One or more of the following features may be included. The fluid sensing safety may include one or more of a capacitance sensing system, a resistance sensing system, and a fluid purity sensing system. The fluid sensing system may include a capacitance sensing system. The capacitance sensing system may include a metallic strip associated with the fluid vessel. The presence of fluid within the fluid vessel may change a capacitance associated with the metallic strip. The metallic strip may be one or more of at least partially disposed in contact with an exterior of the fluid vessel, at least partially disposed within a sidewall of the fluid vessel, and at least partially disposed on an interior of the fluid vessel. The sensing system may be configured to detect a change in capacitance associated with a change in a fluid quantity within the fluid vessel.

The fluid vessel may include one or more of a fluid inlet of the pump, a fluid outlet of the pump, and a fluid passage within the pump. The fluid sensing safety may also include a prime mover controller. The prime mover controller may be communicatively coupled with the sensing system. The prime mover controller may be configured to allow operation of the prime mover when fluid in the fluid vessel exceeds a threshold. The prime mover controller may be configured to disallow operation of the prime mover when fluid in the fluid vessel is less than the threshold. The prime mover controller may be configured to stop the prime mover when fluid in the fluid vessel is less than the threshold for more than a predetermined time period.

According to another implementation, a pressure washer system may include a pressure washer pump, and a prime mover drivingly coupled with the pump. A fluid sensing system may be configured to determine the presence of fluid within a fluid vessel associated with the pump. A controller may be configured to allow operation of the pressure washer pump when at least a threshold quantity of fluid is present in the fluid vessel.

One or more of the following features may be included. The fluid vessel may include one or more of a fluid inlet associated with the pump, a fluid outlet associated with the pump, and a fluid passage within the pump. The fluid sensing system may include a metallic strip. The fluid sensing system may be configured to determine a change in capacitance associated the metallic strip based on a quantity of fluid within the fluid vessel. The metallic strip may be one or more of at least partially disposed in contact with an exterior of the fluid vessel, at least partially disposed within a wall of the fluid vessel, and at least partially disposed within the fluid vessel.

The prime mover may include an engine. The controller may be configured to prevent starting of the engine when less than the threshold quantity of fluid is present in the fluid vessel. The prime mover may include an engine. The controller may be configured to stop operation of the engine when less than the threshold quantity of fluid is present in the fluid vessel for greater than a threshold period of time.

According to yet another implementation, a method may include detecting a fluid quantity in a fluid vessel associated with a pump. The method may include comparing the detected fluid quantity to a threshold. The method may further include controlling a prime mover drivingly coupled with the pump based upon the comparison of the detected fluid quantity to the threshold.

One or more of the following features may be included. Detecting the fluid quantity in the fluid vessel may include measuring one or more of a capacitance, and resistance, and a purity associated with one or more of the fluid vessel and fluid within the fluid vessel. The method may also include determining an operational state of the prime mover. When the operational state of the prime mover indicates the prime mover is running, controlling the prime mover may include stopping the prime mover if the detected quantity of fluid is less than the threshold. When the operational state of the prime mover is not running, controlling the prime mover may include preventing starting of the prime mover if the detected quantity of fluid is less than the threshold.

The prime mover may include an engine. One or more of stopping the prime mover and preventing starting of the prime mover may include grounding an ignition coil of the engine. The method may further include providing an alert if the detected quantity of fluid is less than the threshold.

DESCRIPTION OF ILLUSTRATIVE EXAMPLE EMBODIMENTS

Figure 1B:
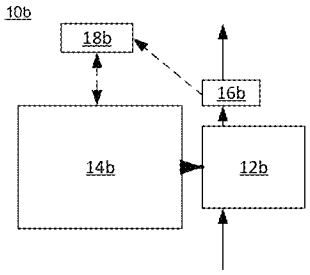
FIGS. 1A-1C schematically depict illustrative example fluid sensing configurations, according to some embodiments.

In general, some embodiments of the present disclosure may provide a sensing and control system that may detect the presence or absence of a fluid (e.g., a liquid, gas, or semi-solid solution/suspension) within a vessel. Further, in some embodiments, the system may allow, or prevent, the operation of a device based upon the presence or absence of the fluid within the vessel. Consistent with various embodiments, the presences or absence of the fluid within the vessel may be detected based upon, at least in part, capacitance sensing, resistance sensing, and/or sensing of the purity of the fluid within the vessel.

In some particular embodiments, the sensing and control system may be utilized in connection with a device that requires the presence of a fluid for desired, safe, and/or effective operation of the device. For example, the device may include, but is not limited to, a pump. In some instances, a pump may utilize the fluid being pumped to provide at least a portion of the cooling and/or lubrication of the pump. In such instances, if the pump is operated in the absence of the fluid being pumped (and/or operated for a time period longer than a threshold time period) the pump (and/or components within the pumping system) may be susceptible to undesired overheating and/or wear. As such, the presence of the fluid may reduce, or prevent, damage to the pump system and/or may reduce, or prevent, negative effects on the integrity of the pump. Accordingly, in such situations it may be desirable to determine whether or not fluid is present during the operation of the pump. Consistent with some embodiments of the present disclosure, a fluid sensing system may be used in conjunction with a pump to detect the presence (and/or absence) of a fluid in the pump. Based upon, at least in part, the determination that fluid is present in the pump, the pump may be allowed to operate and/or continue to operate. Correspondingly, if the presence of fluid is not detected in the pump (and/or fluid that was initially determined to presence is subsequently determined to no longer be present) the pump may be prevented from operating and/or operation of the pump may be discontinued. As generally mentioned, the presence or absence of the fluid may be determined over a time period, and if the presence of fluid is not detected within a threshold time period, the operation of the pump may be prevented and/or may be discontinued. Consistent with such an embodiment, if there is a temporary (e.g., less than the threshold time period) absence of fluid, the pump may be allowed to continue to operate.

As generally noted, the presence (or absence) of fluid may be detected in a vessel associated with the device requiring the presence of the fluid. In the illustrative example in which the device includes a pump, the vessel may include any vessel associated with the pump that may suitably indicate and/or suggest the presence of fluid within critical regions of the pump (i.e., regions that, if the fluid is absent, may result in undesirable effects on the pump and/or the performance or operation of the pump). For example, the vessel may include a portion of a fluid inlet associated with the pump, a portion of a fluid outlet of the pump, a portion of a pumping chamber of the pump, and/or upstream or downstream fluid conduits associated with the pump. In one particular embodiment, the pump may include a pressure washer pump. The fluid vessel may include, for example, a fluid inlet of the pressure washer pump and/or a portion of a fluid inlet conduit to the pump (such as a fluid supply hose). In some instances, the fluid vessel may be proximate the pump, e.g., in which the presence of fluid within the vessel may be more strongly indicative of the presence of fluid within the pump. However, in other instances, the fluid vessel may be remote relative to the pump.

Continuing with the foregoing illustrative example in which the device may include a pressure washer, in one particular illustrative example embodiment the device may include an engine driven pressure washer, e.g., in which a pressure washer pump may be driven by an internal combustion engine. Consistent with such an example embodiment, if fluid is not detected within the fluid vessel (e.g., which may be associated with a fluid inlet of the pressure washer pump), the gasoline engine may be prevented from operating and/or operation of the gasoline engine may be stopped (e.g., if fluid is no longer sensed within the fluid vessel for greater than a threshold period of time). Consistent with such an illustrative example embodiment, the fluid sensing system may safeguard the pressure washer pump against damage, undesired effects, and/or undesired deterioration in performance that may result from operating the pressure washer in the absence of a supply of fluid (and/or an inadequate supply of fluid) to the inlet of the pump.

As noted, a variety of sensing techniques may be utilized consistent with the present disclosure. For example, the sensing system may utilize capacitive sensing of the vessel (and/or of the fluid itself via a capacitive sensor positioned at least partially within the fluid vessel), resistive sensing of the vessel (and/or of the fluid itself via a resistive sensor positioned at least partially within the fluid vessel), purity sensing of the fluid within the fluid vessel, or the like. It will be appreciated that other fluid sensing arrangements may suitably be used in connection with the present disclosure. It will be appreciated that detected capacitance value may vary depending upon the nature and/or type of fluid. Accordingly, one or more sets of capacitance values or threshold ranges may be utilized and/or selected depending upon the fluid being detected. Similarly, resistance values and fluid purity values may also depend upon the nature and/or type of the fluid. Accordingly appropriate values and/or sets of values may be selected depending upon the fluid being detected.

Figure 1A:
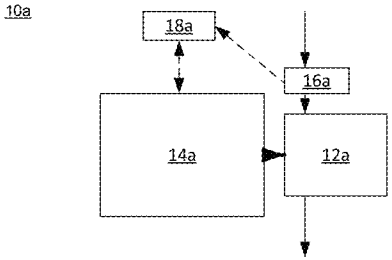
Figure 1C:
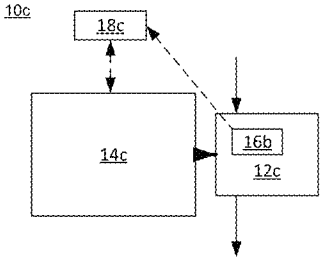

With reference to FIGS. 1A-1C three illustrative example configurations of a system 10*a*-10*c* including a fluid safety are shown. In the illustrative example systems, a pump (e.g., pumps 12*a*-12*c*, respectively) may be driven by a prime mover (e.g., prime movers 14*a*-14*c*, respectively). Consistent with various implementations, the pump may include any suitable pump that may, e.g., convey a fluid, increase a pressure of a fluid (e.g., provide a higher output pressure from the pump as compared to the input pressure of the pump), or the like. Examples of pumps may include, but are not limited to, piston pumps (e.g., including axial piston pumps, such as swashplate (variable or non-variable) driven axial piston pumps, crank driven piston pumps, cam driven piston pumps, etc.), centrifugal pumps, and/or any other suitable pump. Consistent with various embodiments, the prime mover may include any suitable drive system that may be capable of driving the pump (e.g., to provide the pumping action of the fluid). Example of prime movers may include, but are not limited to, engines (e.g., gasoline engine, propane engine, diesel engines, etc.), electric motors (e.g., electric motors, including, but not limited to, induction motors, universal motors, brushed DC motors, brushless DC motors, switched reluctance motors, pancake motors, or the like), hydraulic motors or drives (e.g., which may utilized a pressurized fluid to impart a driving force on the pump), and/or any other suitable prime mover that may be utilized for driving the pump. In some implementations, the system may be implemented in connection with a pressure washer, although other implementations may be equally utilized.

With continued reference to FIGS. 1A-1C, the illustrative example configurations may also include a fluid sensor (e.g., fluid sensors 16*a*-16*c*, respectively) associated with fluid vessels associated with the respective pumps and/or a fluid pathway associated with the fluid pumps. For example, as shown in the illustrated example embodiment of FIG. 1A, a fluid sensor 16*a* may be generally associated with an inlet fluid pathway associated with pump 12*a*. In various configurations, the fluid sensor 16*a* a may be part of and/or coupled to a fluid inlet of the pump 12*a*, and/or may be remote from the pump 12*a*, but may be associated with an inlet fluid pathway (such as a supply hose or conduit, or the like) for the pump. Further, as generally shown in the illustrated example embodiment of FIG. 1B, a fluid sensor 16*b* may generally be associated with an outlet fluid pathway associated with pump 12*b*. In various configurations, the fluid sensor 16*b* may be part of and/or coupled to the fluid outlet of the pump 12*b*, and/or may be remote from the pump 12*b*, but may be associated with an outlet fluid pathway (such as a discharge hose or conduit, or the like). Further, as shown in the illustrative example embodiment of FIG. 1C, a fluid sensor 16*c* may be associated with part of an internal fluid pathway associated with the pump 12*c*. Examples of such internal fluid pathways may include, but are not limited to, an inlet manifold, an outlet manifold, a pump chamber, or the like. As used herein, a fluid vessel may include any form of pipe, hose, conduit, chamber, and/or other open or closed volume that may contain fluid and/or that fluid may pass through and that may be associated with the pump.

Consistent with various implementations, a fluid sensor according to the present disclose may include any suitable arrangement that may be utilized for detecting the presence of a fluid within the fluid vessel, a quantity of fluid within the fluid vessel, a level of fluid within the fluid vessel, and/or a quality or purity of fluid within the fluid vessel. Illustrative examples of such sensor arrangements may include, but are not limited to, capacitive sensors, resistive sensors, and/or purity sensors. Such sensors may detect a change in a value (e.g. a change in capacitance, a change in resistance, a change in sensed voltage, a change in voltage drop, etc.) based upon, at least in part, the presence of fluid within the fluid vessel, a quantity of fluid within the fluid vessel (e.g., different quantities or levels or fluid within the fluid vessel may result in a different detected and/or output value), the nature of fluid within the fluid vessel (e.g., different fluids and/or different fluids at different levels and/or quantities may result in a different detected and/or output value), and/or a change or characteristic of the purity of the fluid in the fluid vessel (e.g., resulting from the inclusion of impurities and/or other components within the fluid).

With continued reference to FIGS. 1A-1C, consistent with some illustrative example embodiments, systems according to the present disclosure may include controllers (e.g., controllers 18*a*-18*c*, respectively). According to various implementations, the controllers may be communicatively coupled with the sensors (e.g., sensors 16*a*-16), e.g., via wired communication channels, wireless communication channels, and/or combinations of wired and wireless communication channels. According to some example implementations, the controller may communicate with a sensing element (e.g., sensors 16*a*-16*c*) to receive a signal (e.g., an output from the sensor, a changed value provided from the sensor, such as a change in voltage, etc.) which may be indicative of a characteristic of fluid within the fluid vessel (e.g., presence or absence of fluid, quantity of fluid, level of fluid, purity of fluid). For example the controller may include one or more processors, circuits, or the like that may determine a fluid characteristic based upon a signal, output, or characteristic of the sensor. In some implementations, the controller may include suitable hardware, software, and/or firmware for detecting the signal, output, and/or value associated with the sensor, e.g., and comparing the same to one or more reference values, thresholds, or the like, e.g., for determining a characteristic of fluid within the fluid vessel based upon the signal, output, and/or value associated with the sensor.

Consistent with some implementations, a controller may be provided communicatively coupled with the prime mover and/or may capable of detecting one or more operational characteristics associated with the prime mover and/or capable of controlling one or more operational characteristics associated with the prime mover. For example, in some embodiments, the controller may be capable of detecting whether or not the prime mover is running (e.g., driving the pump). For example, the controller may be capable of detecting voltage spikes associated with the firing of a spark plug of an engine, may be capable of detecting an output from an speed sensor (such as a crankshaft speed sensor), detecting a state of a relay or switch (such as associated with an electric motor), and/or may be capable of detecting various additional and/or alternative operational characteristics associated with the prime mover. Further, the controller may be configured to control, at least in part, one or more operational characteristics associated with the prime mover. For example, in some implementations, the controller may be capable of allowing and/or disallowing operation of the prime mover. For example, in an embodiment in which the prime mover includes an engine, the controller may be capable of preventing the starting of the engine and/or may be capable of shutting down the engine. In one particular implementation, the controller may include hardware (e.g., such as a relay, transistor, etc.) that may be capable of grounding the ignition coil of the engine, thereby either shutting down the running engine and/or preventing the starting of the engine. Other suitable mechanisms may also be implemented. In an embodiment in which the prime mover includes a motor, the controller may be capable of preventing the operation of the motor and/or ceasing operation of the motor. For example, the controller may include hardware (such as a relay, transistor, etc.) that may be capable of cutting off power to the motor. Further, in some embodiments the controller may communicate with another prime mover controller (either for an engine or for a motor) to control one or more operation characteristics of the prime mover.

While the controllers 18*a*-18*c* are shown as being communicatively coupled with both the sensors and the prime movers, this is for illustrative convenience only. In some implementations, separate controllers may be provided associated with the sensors (e.g., a sensor controller) and associated with the prime mover (e.g., a prime mover controller, such as an engine controller and/or a motor controller). In some such implementation, the sensor controller and the prime mover controller may be communicatively coupled (e.g., via a wired and/or a wireless communication channel), e.g., to allow control of one or more operational characteristics of the prime mover in response to one or more sensed fluid characteristics.

Figure 2A:
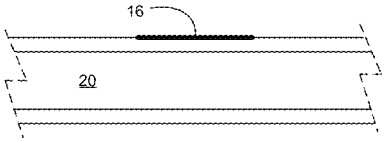
FIGS. 2A-2C schematically depict illustrative example fluid sensing element configurations, according to some embodiments.
Figure 2B:
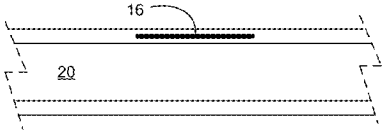
Figure 2C:
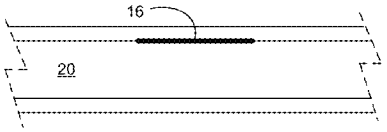
Figure 3:
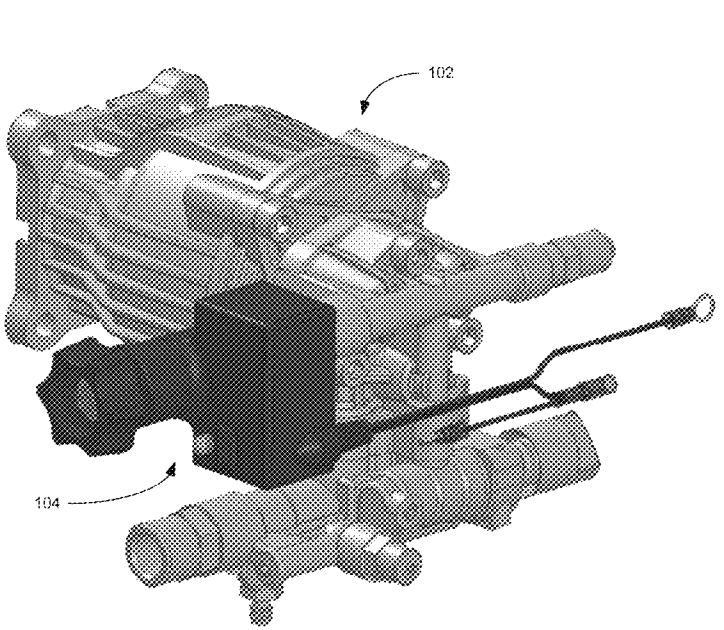
FIG. 3 is a perspective view of a pump coupled with a fluid sensor, according to an illustrative example embodiment.
Figure 4:
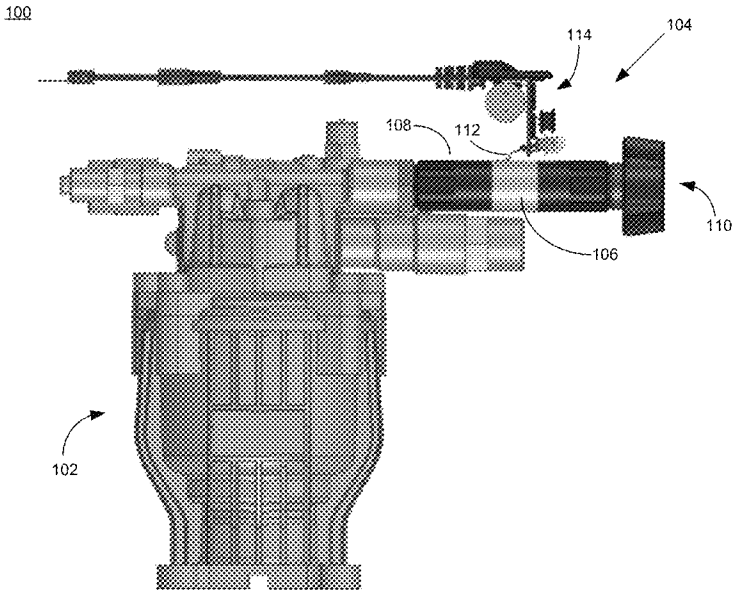
FIG. 4 depicts the implementation of the pump and sensor shown in FIG. 3 with the sensor housing removed.
Figure 5:
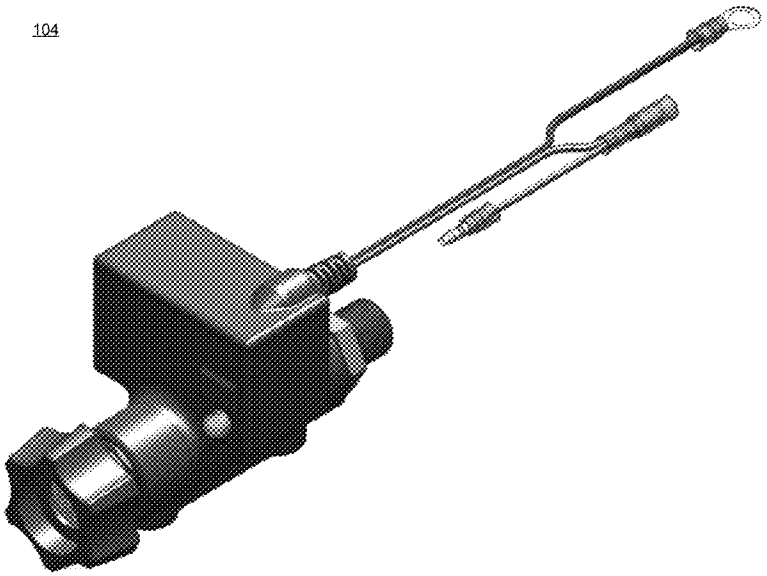
FIG. 5 is a perspective view of the implementation of the sensor shown in FIGS. 3 and 4.
Figure 6:
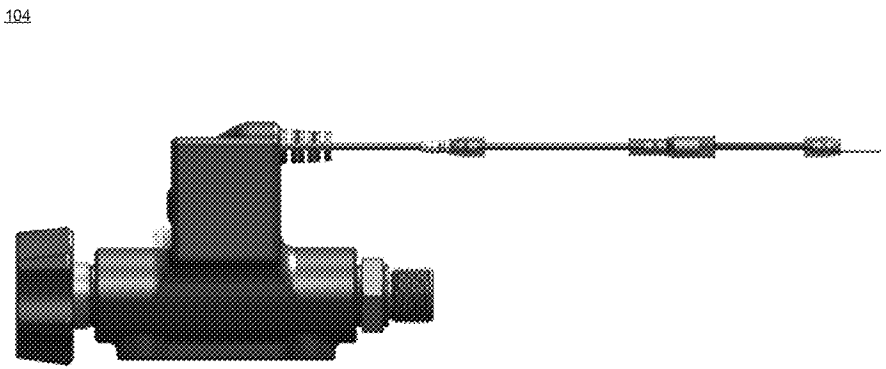
FIG. 6 is a side elevation view of the implementation of the sensor shown in FIGS. 3 and 4.
Figure 7:
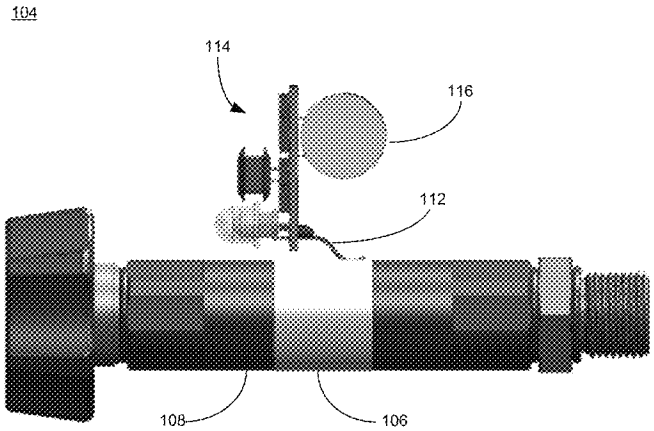
FIG. 7 is a side elevation view of the sensor shown in FIGS. 3 and 4 with the sensor housing removed.
Figure 8:
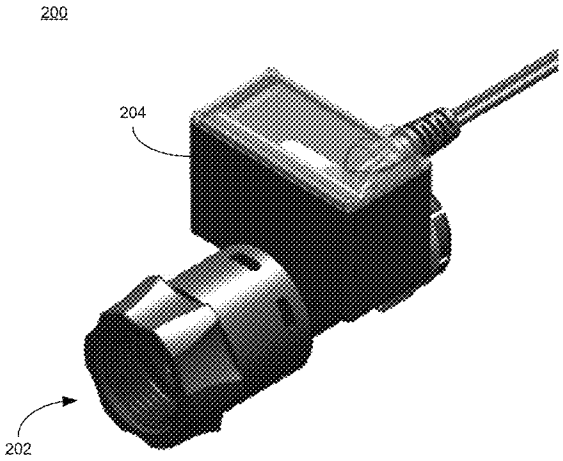
FIG. 8 is a perspective view of another illustrative example embodiment of a sensor including a vacuum breaker, according to an example embodiment.
Figure 9:
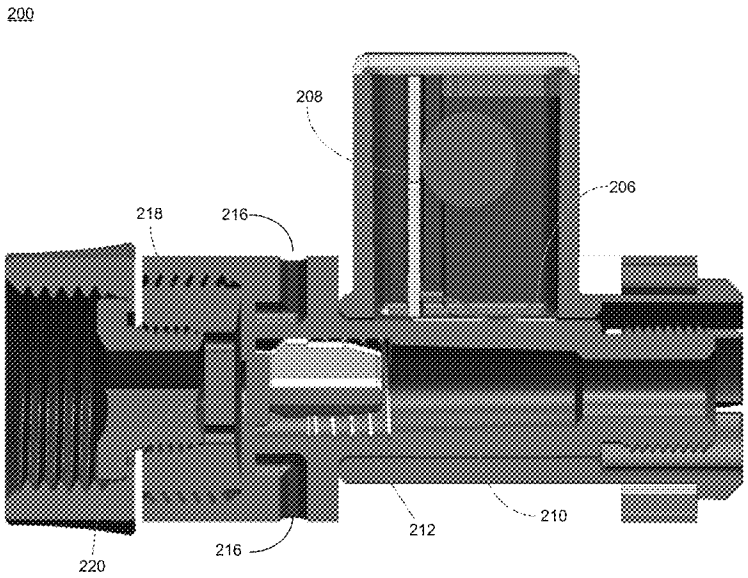
FIG. 9 is a cross-sectional view of the sensor shown in FIG. 8, according to an example embodiment.
Figure 10:
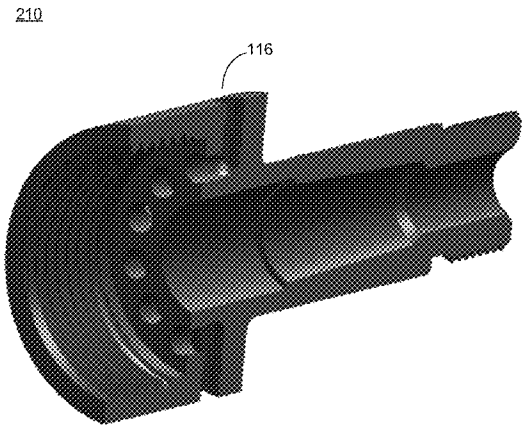
FIG. 10 is a cross-sectional view of an inlet tube of the sensor of FIG. 8, depicting the vacuum breaker vent ports, according to an example embodiment.
Figure 11:
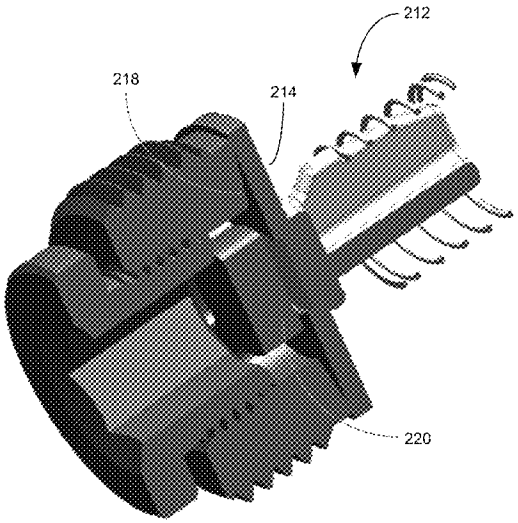
FIG. 11 is a cross-sectional view of a vacuum breaker valve of the sensor of FIG. 8, according to an example embodiment.

As noted above, a variety of fluid sensors may be utilized for sensing the presence or absence of fluid within a fluid vessel, for sensing a quantity of fluid within the fluid vessel, for sensing a level of fluid within the fluid vessel, for sensing a purity of fluid within the fluid vessel, and the like. Illustrative example of such fluid sensors may include, but are not limited to, capacitive sensing arrangements, resistive sensing arrangements, and/or purity sensing arrangements (e.g., including optical and/or other sensing arrangements). Further, it will be appreciated that a variety of placements of the sensors may be implemented, e.g., relative to the fluid vessel. It will be appreciated that the placement of the fluid sensor relative to the fluid vessel may vary, e.g., depending upon the nature of the fluid sensor arrangement, the nature of the fluid vessel (e.g., the location of the fluid vessel, the material from which the fluid vessel is made, etc.), as well as various other considerations. With reference to FIGS. 2A-2C, various non-limiting illustrative example sensor arrangements are depicted. For example, a fluid sensor 16 may be arranged to be at least partially disposed in contact with an exterior of a fluid vessel 20, as shown in FIG. 2A. Further, a fluid sensor 16 may be arranged to be at least partially disposed within a wall of a fluid vessel 20, as shown in FIG. 2B. Still further, a fluid sensor 16 may be arranged to be disposed at least partially in contact with an interior of a fluid vessel 20, as shown in FIG. 2C. It will be appreciated that a variety of additional and/or alternative arrangements, including combinations of such arrangements, may be implemented.

Referring to FIGS. 3-7, an illustrative example embodiment fluid sensing safety system 100 is generally shown. Further the purpose of description, this illustrative example embodiment will be discussed in the context of a gasoline pressure washer system (e.g., a system including a pump and a gasoline prime mover, as generally schematically shown and described above). For example, and with particular reference to FIGS. 3 and 4, the fluid sensing safety system 100 is shown including a pump 102 (e.g., which may include an axial piston pump that may be driven by a gasoline engine, not shown) including a fluid sensor 104 associated with a fluid inlet of the pump 102. In the illustrative example embodiment, the fluid sensor 104 (depicted without the housing in FIGS. 4 and 7) is shown including a capacitive sensing element 106 that may be attached to an inlet pipe 108 of the pump 102. As shown, in some implementations, the inlet pipe 108 of the pump 102 may include an inlet coupling 110 (e.g., which may be configured to be coupled to a fluid supply such as a garden hose, or other fluid supply line). In this illustrated embodiment, the fluid vessel may include the portion of the inlet pipe of the fluid supply pump. As shown, in the illustrated example embodiment, the capacitive sensor may be attached to the exterior of the inlet pipe. It will be appreciated that other arrangements may suitable by utilized, including, but not limited to, attaching the capacitive sensor to an interior of the inlet pipe and integrating the capacitive sensor into the inlet pipe (e.g., within the wall of the inlet pipe), e.g., as previously shown and described. It will also be appreciated that other portions of the pump and/or fluid system of the pump (inlet side or outlet side) may be utilized as the fluid vessel, as also previously shown and described.

Consistent with the illustrated embodiment, the sensor 104 may provide the ability to detect a change in capacitance (e.g., which may manifest as a change in voltage of current passing through the sensing element 106) when fluid is present in the inlet pipe versus when no fluid (and/or less than a threshold volume or flowrate of fluid) is present in the pump. In one particular illustrative example, the sensing element 106 may include a strip (or other configuration) of aluminum foil (and/or another metallic or conductive material) affixed to the inlet pipe 108. The strip of aluminum foil may be electrically coupled (e.g., via the illustrated spring contact 112, or other suitable electrical coupling) with a suitable controller (e.g., which may include a microprocessor and/or any other suitable circuitry). Consistent with the illustrated example embodiment, the controller is shown embodiment on a printed circuit board 114, which may include a microprocessor and/or various additional and/or alternative hardware and/or circuitry). However, as noted previously, in some implementations that sensor controller may be located remotely relative to the sensing element, and may be communicatively coupled with the sensing element via suitable wired and/or wireless communication channel. Further, as generally discussed above, in additional to the various hardware components (e.g., microprocessor, circuitry, etc.), the sensor controller may implement suitable software and/or firmware for implementing the functionality of the sensor. Further, as also discussed above, the sensor controller may be configured to communication and/or interact with a prime mover and/or a prime mover controller. In the illustrated example embodiment, the sensor 104 (which may include a commonly housed sensor controller) is shown including a wiring harness (e.g., a wire communication channel) that may allow the sensor to the communicatively coupled with a prime mover, a prime mover controller, and/or one or more additional controllers and/or control systems. It will be appreciated that in various additional and/or alternative implementations, the sensor (and/or the sensor controller) may be configured for wireless communication with the prime mover, the prime mover controller, and/or one or more additional controllers and/or control systems.

In some embodiments, the material and thickness of the inlet pipe may be known and utilized for programming the capacitance values (e.g., of a software, hardware, and/or firmware control system, e.g., which may be executed by the microprocessor and/or other suitable circuitry and/or components). Additionally/alternatively, the control system may be empirically programmed, designed, or configured (e.g., without the use of independently calculated capacitance values). For example, a detected capacitance of the inlet pipe may be determined when the inlet pipe is filled with fluid. Correspondingly, a detected capacitance of the inlet pipe when it is not filled with fluid (and/or is filled below a threshold proportion) may be determined. Accordingly, the control system may be configured based upon such empirically determined detected capacitance values.

In an illustrative example embodiment, and as generally described above, the sensor and/or sensor controller may be operatively coupled with an electric ignition system (and/or a prime mover controller, which may be separate from and/or combined with the sensor controller) of an internal combustion engine (e.g., a gasoline engine, a diesel engine, a propane engine, etc.). As such, the sensor controller (alone and/or in conjunction with the prime mover controller) may allow and/or prevent operation of the engine depending upon the detected capacitance (e.g., which may indicate the presence or absence of fluid within the inlet pipe). In another embodiment, the sensor controller (alone and/or in conjunction with the prime mover controller) may be operatively coupled with an electric power switch circuit of an electric motor (e.g., of an electric motor driven pressure washer). Consistent with the foregoing illustrative examples, for an engine driven pressure washer, the engine may be started and may be running. The operation of the engine may be detected by the control system (e.g., one or more of the prime mover controller and/or the sensor controller), e.g., via the detection of high voltage spikes through the ignition system of the engine, and/or via other suitable sensing or detection arrangements. However, if no fluid (e.g., water) is present in the inlet pipe (e.g. as a result of the fluid source being obstructed, such as by a kinked supply hose; as a result of the fluid source not being connected; as a result of the fluid source not being turned on; etc.), the capacitance detected by the sensor may not change and/or indicate a predetermined capacitance value associated with the presence of water in the inlet pipe. Based upon, at least in part, the detected capacitance value not corresponding to (and/or being within a range of) a capacitance value associated with the presence of water in the inlet pipe (and/or a detected capacitance value associated with no water, or an insufficient supply of water, in the inlet pipe), the sensor controller may determine that there is no fluid (and/or an insufficient flow of fluid) at the inlet of the pump. Accordingly, the sensor controller (alone and/or in conjunction with the prime mover controller, which may be separate from and/or combined with the sensor controller) may initiate a shutdown sequence to stop the engine from running. In one particular illustrative embodiment, the control system may stop the engine by grounding the voltage and current of the ignition coil of the engine. Additionally and/or alternatively, the control system may determine whether fluid is present at the inlet pipe prior to allowing the engine to be started.

If the sensor capacitance changes as a result of the presence of water in the inlet pipe (e.g., the detected capacitance is within a threshold range indicative of the presence of water in the inlet pipe), the sensor controller (alone and/or in conjunction with the prime mover controller) may allow the engine ignition system to remain open (i.e., may allow the engine to continue running) until the engine kill switch is closed or turned off (e.g., by a user of the pressure washer) to stop the engine. While the engine is running, the control system (e.g., which may include one or more of the sensor controller and the prime mover controller) may continuously and/or intermittently (e.g., at defined time intervals, and/or upon the occurrence of a trigging event) monitor the capacitance voltage of the sensor. The control system may stop the engine if one or more detected capacitance values is outside of the range indicating the presence of fluid in the inlet pipe. For example, the control system may shut down the engine if a water supply hose to the pressure washer is pinched, or kinked, and the flow of water to the pump is stopped, or falls below a threshold flowrate. As such, damage to the pump (e.g., pump seals and/or other sensitive components that may require water to keep the pump cool and/or lubricated) may be prevented and/or reduce.

As generally discussed above, in some embodiments, the control system may be configured to "hold" the grounding circuit for the ignition coil closed for a predetermined period of time to ensure that the engine has stopped. In some embodiments, a battery or a capacitor (e.g., such as capacitor 116, shown in FIG. 7) may be utilized to provide the necessary power to "hold" the ground circuit until the engine has completely stopped. It will be appreciated that in some implementations, e.g., which may include a separate prime mover controller, the prime mover controller may include a battery and/or capacitor to provide the necessary power to ensure proper shutdown of the prime mover.

Referring also to FIGS. 8-11, another implementation of a sensor 200 is shown. In general, the sensor 200 may generally correspond with the sensor shown in FIGS. 4-7 with the additional incorporation of a vacuum breaker arrangement. As such, the sensor arrangement 200 may generally include an inlet 202, which may be coupled to a fluid supply, such as a garden hose or other fluid supply. A sensor housing 204 may generally enclose a sensing element 206 and a sensor controller, that may be embodied on PCB 208 (e.g. which may alternatively be remotely located relative to the inlet and the sensing element). As shown, the sensing element 206 may generally be disposed to be in contact with at least a portion of an exterior of a fluid vessel, which may be in the form of an inlet pipe 210, in the illustrated example embodiment. However, as discussed above, other configuration are contemplated (both for the arrangement of the sensing element and for the location/nature of the fluid vessel) consistent with the present disclosure.

Consistent with the depicted example embodiment, the vacuum breaker arrangement may include a spring biased piston 212, generally. The piston 212 may be biased to engage a gasket 214. When fluid is supplied to the inlet 202 at a pressure greater than the biasing force provided by the spring, the piston 212 may be urged away from the gasket 214 to allow the fluid to flow past the gasket and piston through the inlet pipe 210 to the pump. When the pressure supplied to the inlet is less than the force provided by the spring, the piston may seat against the gasket, e.g., which may seal the inlet pipe. The vacuum breaker arrangement may also include one or more atmospheric vents (e.g., vents 216) that may extend from an exterior of the sensor and may provide fluid communication between the exterior of the sensor and a rear of the gasket (e.g., a side of the gasket facing the piston). When a pressure at the inlet 202 (e.g., on the inlet side of the gasket) exerted on the gasket is less than the atmospheric pressure exerted on the gasket via the atmospheric vents 216 (taking into account differences in the exposed surface area of the gasket exposed to each pressure), the gasket may deflect toward the inlet (e.g., by virtue of the flexibility of the gasket, which may be a rubber material, elastomeric material, and/or other flexible material or membrane) due to the angled seat 218 (e.g., best depicted in FIGS. 9 and 11). Deflection of the gasket 214 toward the inlet 202 may be constrained, at least in part, by stop 220. Deflection of the gasket may open the seal between the gasket 214 and the piston 212, e.g., which may allow fluid to drain from the inlet pipe 210 (and possibly from the pump) and out through the vents 216. In some such implementations, the vacuum breaker arrangement may, for example, prevent siphoning of fluid from the pump back to the fluid source.

Figure 12:
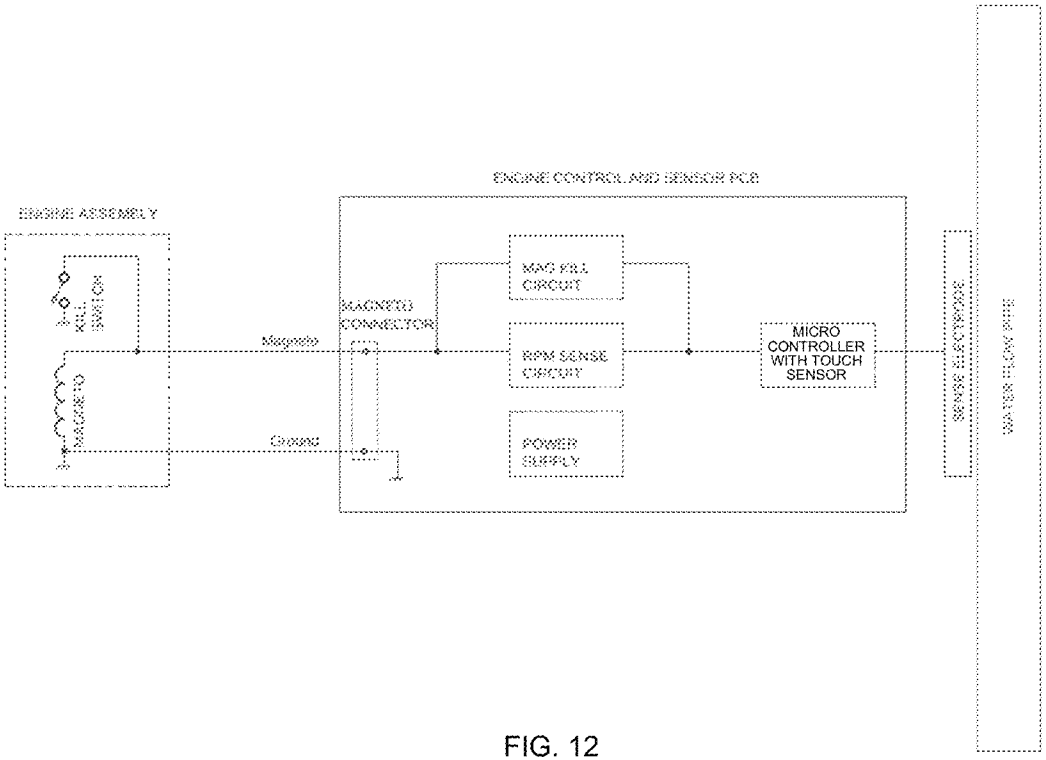
FIG. 12 is a schematic block diagram of an illustrative example embodiment of a fluid sensing safety system, according to an example embodiment.

Referring also to FIG. 12, a schematic block diagram of an illustrative example implementation consistent with some embodiments of the present disclosure is shown. As generally depicted, a sensor electrode may be associated with a fluid vessel (e.g., the depicted water flow pipe). A control system may be embodied as an engine control and sensor PCB, and may include a microcontroller configured to receive a signal (such as, but not limited to, an output voltage) from the sensor. It will be appreciated that in other implementations, a separate engine control system and sensor control system may be utilized. In some such implementations, the engine control system and the sensor control system may be communicatively coupled. Additionally, as shown the control system may receive a signal from the engine, which may provide an indication of whether the engine is running. For example, the control system may include an engine RPM sense circuit that may detect an engine RPM based upon magneto spikes, or other suitable inputs. In implementations in which the prime mover may include an electric motor, the control system may include an RPM sense circuit for the motor (e.g., from an RPM sensor or from a motor speed controller), may include a power switch state (e.g., which may indicate an on/off state of the motor), and/or may detect power (voltage and/or current) applied to the motor (e.g., to a rotor coil, to a stator coil, etc., depending upon the configuration of the motor).

In an implementation in which the prime mover may include an engine, the control system may further include a magneto kill circuit, e.g., which may be configured to cause the magneto to be grounded to stop/prevent operation of the engine, or another suitable engine shutdown arrangement. In an implementation in which the prime mover may include a motor, the control system may include a relay, e.g., which may be opened (or closed, depending upon the control system architecture) to prevent the flow of electricity to the motor, and/or may send a signal to a motor control to stop the motor. As generally discussed above, the control system (e.g., which may include a microcontroller) may receive an input from the sensor, and based upon the received input may allow the prime mover to run (e.g., if the sensor input indicates the presence of the fluid) and/or may prevent the prime mover from running/stop the prime mover running (e.g., if the sensor input indicates the absence of the fluid), e.g., by triggering the magneto kill circuit, opening a motor power relay, and/or via other suitable arrangement. It will be appreciated that various additional and/or alternative feature may be included. For example, in an implementation in which the prime move includes and engine having a lower oil shutdown, a wire harness may be provided from the sensor (and/or a sensor controller or a control system including the sensor controller and, e.g., an engine controller) and may extend to the engine low oil shutdown sensor or an on/off switch of the engine. In such configurations, the engine low oil shutdown system and/or the on/off switch of the engine may be utilized to prevent the engine from running and/or to shut down the engine. Further, in some example embodiments, a sensor wire may be wrapped around, and/or otherwise operatively associated with, a spark plug lead to detect the magneto/voltage pulses to inform the control system as to whether the engine is currently operating, is stopped, is attempting to start, etc. In addition and/or as an alternative to stopping the engine/preventing the engine from starting, the control system may be configured to provide an audible and/or visual alert to an operator indicating the absence of fluid (e.g., such as a buzzing, siren, flashing LED, etc.).

Figure 13:
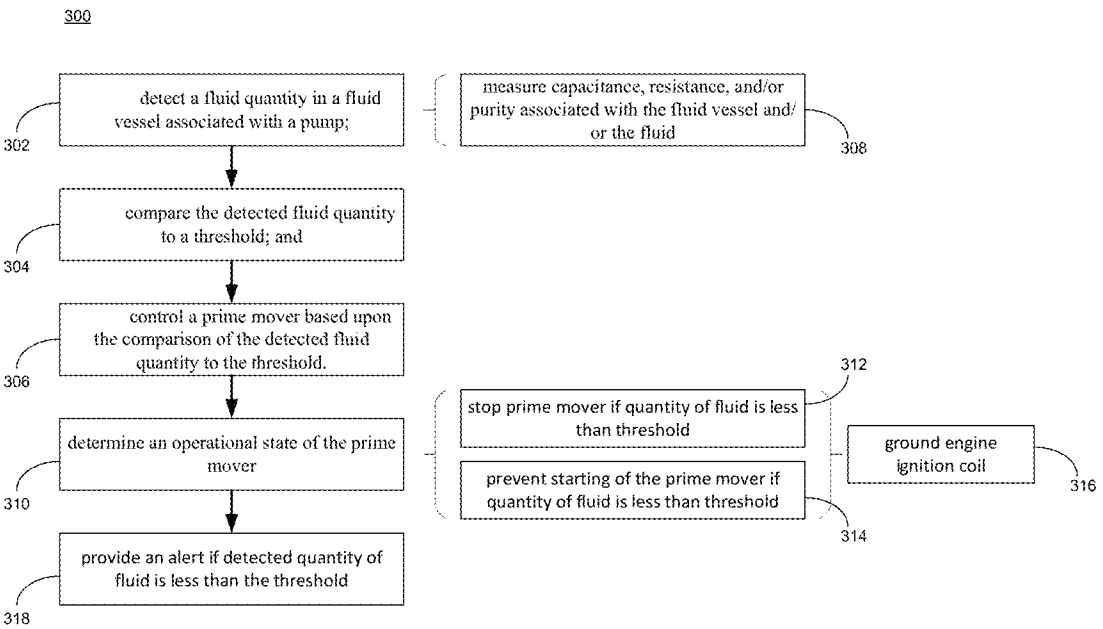
FIG. 13 is a flow diagram of a method that may be implemented by a fluid sensing safety system, according to an example embodiment.

With additional reference to FIG. 13, and illustrative example method for providing fluid sensing safety, as for a pump driven by a prime mover is generally depicted. Consistent with the present disclosure, providing fluid sensing safety may be carried out by a sensor controller alone, a prime mover controller alone, a sensor controller in combination with a prime mover controller, and/or an additional controller, alone and/or in combination with one or more of a sensor controller and a prime mover controller. For the purpose of discussion, any such arrangement, configuration, and/or combination may generally be referred to as "control system." According to the example embodiment, a control system may generally detect 302 a fluid quantity in a fluid vessel associated with a pump. Further, the control system may generally compare 304 the detected fluid quantity to a threshold. Further, the control system may control 306 a prime mover driving coupled with the pump based upon, at least in part, the comparison of the detected fluid quantity to the threshold.

As noted above, the control system may detect 302 a fluid quantity in a fluid vessel associated with a pump. For example, a sensing element may provide a signal and/or output based upon, at least in part whether or not fluid is present within the fluid vessel, a quantity of fluid present in the fluid vessel, a level of fluid in the fluid vessel, and/or a purity of fluid in the fluid vessel. Consistent with various embodiments, the sensing element may include, but is not limited to, a capacitive sensing element, a resistive sensing element, and/or a purity sensing element (such as an optical sensing element or the like). The control system may continuously and/or intermittently detect 302 the fluid quantity in the fluid vessel. Intermittently detecting 302 the fluid quantity may include, but is not limited to, detecting 302 the fluid quantity at predetermined time intervals (e.g., 0.5 s, 1 s, 2 s, 5 s, 10 s, 30 s, etc), and/or may include detecting 302 the fluid quantity at predetermine events (e.g., attempted starting of a prime mover).

The control system may compare 304 the detected fluid quantity to a threshold. That is, for example, the control system may compare a signal and/or value from the sensing element with one or more reference signals and/or values having associated fluid quantities (e.g., the presence of fluid, the absence of fluid, a fluid level, a fluid purity). Based upon, at least in part, the comparison of the signal or value from the sensing element with one or more reference signals and/or values, the control system may determine, for example, whether fluid is present in the fluid vessel, a quantity or level of fluid within the fluid vessel, and/or a purity of fluid within the fluid vessel. Consistent with some implementations, the reference signals and/or values may be programmatically determined, e.g., based upon, for example know characteristics of the fluid vessel (such as a material of the fluid vessel, a thickness of a wall of the fluid vessel, etc.) and of the fluid or fluids expected to be used. In some implementations, the reference signals and/or values may be empirically determined, e.g., based upon, at least in part, creating different fluid conditions relative to the fluid vessel and recording the resulting sensed signal and/or output. Further, in some implementations, more than one set of reference signals and/or outputs may be utilized by the control system, e.g., which may accommodate different fluid types, different operating conditions (e.g., different temperatures, etc.). Further, the reference signal and/or output may define one or more thresholds, e.g., which may in turn define safe operating conditions for the pump (i.e., within the threshold sufficient quantity, flowrate, quality, etc. of fluid may be present in the pump to permit safe operation of the pump).

Further, the control system may control 306 the prime mover driving coupled with the pump based upon, at least in part, the comparison of the detected fluid quantity to a threshold. For example, in some embodiments operation of the prime mover (and thereby of the pump driven by the prime mover) may be allowed when a sufficient quantity, flowrate, and/or purity of fluid is present for safe operation of the pump (e.g., without resulting in undesired damage or wear), and operation of the prime mover may be disallowed when sufficient quantity, flowrate, and/or purity of fluid is not present to allow safe operation of the pump. In some implementations, the control system may determine 310 an operational state of the prime mover and/or of the pump. For example, the control system may determine if the prime mover is running and/or if the pump is operating. Consistent with an embodiment in which the prime mover may include an engine, voltage spike in an ignition coil and/or spark plug wire may be detected, the presence of which may indicate that the engine is running. Other techniques may be utilized to determine if the engine, electric motor, or pump are operating, including, but not limited to, the state of a power switch (e.g., of an electric motor), a shaft RPM (e.g., of an engine crankshaft, motor drive shaft, pump input shaft), or the like. In some embodiments, the control system may detect 310 the operational state of the prime mover continuously and/or intermittently (e.g., corresponding to a detection of the quantity of fluid within the fluid vessel).

In an embodiment, the control system may detect 310 that the operation state of the prime mover indicates the prime mover is running. Further, controller 306 the prime mover may include stopping 312 the prime mover if the detected quantity of fluid is less than the threshold. In an embodiment, the control system may detect 310 that the operational state of the prime mover indicates that the prime mover is not running. In such an embodiment, controlling 306 the prime mover may include preventing 314 starting of the prime mover if the detected quantity of fluid is less than the threshold. In an illustrative example embodiment in which the prime mover may include an engine, one or more of stopping 312 the prime mover and preventing 314 starting of the prime mover may include grounding 316 the ignition coil of the engine. It will be appreciated that other techniques for stopping/preventing starting of an engine may also be implemented. In an illustrative example embodiment in which the prime mover may include an electric motor, stopping 312 and/or preventing starting 314 of the electric motor may include disconnecting power to the motor (e.g., as by opening a relay, a solid state switch, or the like).

In some embodiments, the control system may further provide 318 an alert if the detected quantity of fluid is less than the threshold. The alert may include, but is not limited to, an audible alert (such as a buzzer or alarm), a visual alert (such as an illuminated or flashing light or LED), an alert sent to a mobile device (such as a smartphone or smart watch), and/or a combination of such alerts.

While various illustrative example embodiments have been described herein, including particular features and combinations of features, it will be appreciated that implementations may be provided consistent with the present disclosure that incorporate various combinations of elements and features described across the various illustrative example embodiments, and/or that may incorporate additional and/or alternative elements and features and/or combinations of elements and features. As such the described illustrative example embodiments should be understood as describing possible features, objectives, and advantages of the present disclosure, and are intended for illustrative purposes only. Further, the elements, features, and concepts of the present disclosure are susceptible to modification and variation, as will be appreciated by those having skill in the art. As such, the scope of the present invention should not be construed as limited to any of the described embodiments.

What is claimed is:

1. A pressure washer system comprising:

a pressure washer pump;

a prime mover drivingly coupled with the pump;

a fluid sensing system configured to determine the presence of fluid within a fluid vessel associated with the pump, the fluid sensing system includes a vacuum breaker arrangement that prevents siphoning fluid from the pump to a fluid source, wherein the vacuum breaking arrangement includes a piston biased to engage a gasket to seal a fluid inlet when a pressure of the fluid at the inlet is less than the bias force and one or more atmospheric vents providing fluid communication between an exterior of the fluid sensing system and a side of the gasket facing the piston to cause the gasket to deflect toward the fluid inlet when pressure on a fluid inlet side of the gasket is less than pressure exerted on the gasket via the one or more atmospheric vents to open a seal between the piston and the gasket to allow fluid to drain from the fluid sensing system; and a controller configured to allow operation of the pressure washer pump when at least a threshold quantity of fluid is present in the fluid vessel.

2. The pressure washer system according to claim 1, wherein the fluid vessel includes one or more of a fluid inlet associated with the pump, a fluid outlet associated with the pump, and a fluid passage within the pump.

3. The pressure washer system according to claim 1, wherein the fluid sensing system includes a metallic strip and the fluid sensing system is configured to determine a change in capacitance associated the metallic strip based on a quantity of fluid within the fluid vessel.

4. The pressure washer system according to claim 3, wherein the metallic strip is one or more of at least partially disposed in contact with an exterior of the fluid vessel, at least partially disposed within a wall of the fluid vessel, and at least partially disposed within the fluid vessel.

5. The pressure washer system according to claim 1, wherein the prime mover includes an engine, and the controller is configured to prevent starting of the engine when less than the threshold quantity of fluid is present in the fluid vessel.

6. The pressure washer system according to claim 1, wherein the prime mover includes an engine, and the controller is configured to stop operation of the engine when less than the threshold quantity of fluid is present in the fluid vessel for greater than a threshold period of time.

* * * * *